US011097535B2

(12) United States Patent
Oikawa et al.

(10) Patent No.: US 11,097,535 B2
(45) Date of Patent: Aug. 24, 2021

(54) PRINTING APPARATUS AND DISCHARGE STATUS JUDGMENT METHOD

(71) Applicant: CANON KABUSHIKI KAISHA, Tokyo (JP)

(72) Inventors: Yuhei Oikawa, Yokohama (JP); Masashi Hayashi, Yokohama (JP); Toshiyuki Chikuma, Tokyo (JP); Yutaka Kano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/361,377

(22) Filed: Mar. 22, 2019

(65) Prior Publication Data

US 2019/0299601 A1 Oct. 3, 2019

(30) Foreign Application Priority Data

Mar. 28, 2018 (JP) ..... JP2018-062260

(51) Int. Cl.
*B41J 2/045* (2006.01)
*B41J 2/21* (2006.01)

(52) U.S. Cl.
CPC ..... *B41J 2/04563* (2013.01); *B41J 2/0451* (2013.01); *B41J 2/0458* (2013.01); *B41J 2/04588* (2013.01); *B41J 2/2142* (2013.01)

(58) Field of Classification Search
CPC .... B41J 2/04563; B41J 2/0451; B41J 2/0458; B41J 2/04588; B41J 2/2142
See application file for complete search history.

(56) References Cited

U.S. PATENT DOCUMENTS 7,806,503 B2 10/2010 Aoki et al.
7,914,106 B2 3/2011 Takabayashi et al.
7,935,389 B2 5/2011 Takahashi et al.
8,186,798 B2 5/2012 Aoki et al.
(Continued)

FOREIGN PATENT DOCUMENTS

CN 1738714 A 2/2006
CN 1955002 A 5/2007
(Continued)

OTHER PUBLICATIONS

U.S. Appl. No. 16/361,380, Yuhei Oikawa Toshiyuki Chikuma Yutaka Kano Kohei Sato, filed Mar. 22, 2019.
(Continued)

*Primary Examiner* — Thinh H Nguyen
(74) *Attorney, Agent, or Firm* — Venable LLP

(57) ABSTRACT

A printing apparatus using a printhead that includes an inspection circuit for inspecting an ink discharge status for each nozzle performs an inspection processing. The apparatus selects a nozzle as a target of inspection of the ink discharge status, sets a threshold value for inspecting a detection result of a temperature detection element corresponding to the selected nozzle, and uses the inspection circuit and the set threshold value. The apparatus receives, from the printhead, an inspection result for the selected nozzle, determines, based on the received inspection result, a threshold value to be used by the inspection circuit for inspecting the discharge status of the selected nozzle in a subsequent inspection, and stores the determined threshold value in a memory.

24 Claims, 9 Drawing Sheets

(56) References Cited

U.S. PATENT DOCUMENTS

| | | | | |
|---|---|---|---|---|
| 8,210,640 | B2 * | 7/2012 | Takabayashi | B41J 2/04563 347/19 |
| 8,287,082 | B2 | 10/2012 | Aoki et al. | |
| 8,439,468 | B2 | 5/2013 | Yokozawa et al. | |
| 8,814,296 | B2 | 8/2014 | Yazawa et al. | |
| 8,845,064 | B2 | 9/2014 | Ike | |
| 8,950,843 | B2 | 2/2015 | Oikawa et al. | |
| 9,033,442 | B2 | 5/2015 | Kanno et al. | |
| 9,114,611 | B2 | 8/2015 | Ike | |
| 9,205,644 | B2 | 12/2015 | Hosokawa | |
| 9,492,997 | B2 | 11/2016 | Zhang et al. | |
| 9,636,907 | B2 | 5/2017 | Shinkawa et al. | |
| 9,981,465 | B1 | 5/2018 | Mu et al. | |
| 10,099,473 | B2 | 10/2018 | Anderson et al. | |
| 2006/0250465 | A1 | 11/2006 | Anderson et al. | |
| 2007/0064040 | A1 | 3/2007 | Kim | |
| 2007/0291081 | A1 | 12/2007 | Kanno et al. | |
| 2010/0053249 | A1 | 3/2010 | Matsushita et al. | |
| 2010/0156978 | A1 | 6/2010 | Yokozawa et al. | |
| 2010/0156982 | A1 | 6/2010 | Sasagawa | |
| 2011/0211000 | A1 | 9/2011 | Aoki et al. | |
| 2011/0261104 | A1 | 10/2011 | Tatsumi | |
| 2012/0194591 | A1 * | 8/2012 | Hagiwara | B41J 2/04563 347/14 |
| 2017/0305146 | A1 | 10/2017 | Mihailovic et al. | |
| 2020/0023638 | A1 | 1/2020 | Anderson et al. | |

FOREIGN PATENT DOCUMENTS

| | | | |
|---|---|---|---|
| CN | 101092082 | A | 12/2007 |
| CN | 101665021 | A | 3/2010 |
| CN | 103042827 | A | 4/2013 |
| CN | 103129143 | A | 6/2013 |
| CN | 103395291 | A | 11/2013 |
| CN | 104097398 | A | 10/2014 |
| CN | 104441991 | A | 3/2015 |
| CN | 105939858 | A | 9/2016 |
| CN | 106004047 | A | 10/2016 |
| JP | 2003-291349 | A | 10/2003 |
| JP | 2008-000914 | A | 1/2008 |

OTHER PUBLICATIONS

Extended European Search Report dated Aug. 5, 2019, issued in European Patent Application No. 19162249.7.

Extended European Search Report dated Aug. 5, 2019, issued in European Patent Application No. 19162257.0.

Office Action dated May 29, 2020, in Chinese Patent Application No. 201910235076.5.

Office Action dated Jul. 3, 2020, in Chinese Patent Application No. 201910235075.0.

* cited by examiner

PRINTING APPARATUS AND DISCHARGE STATUS JUDGMENT METHOD

BACKGROUND OF THE INVENTION

Field of the Invention

The present invention relates to a printing apparatus and a discharge status judgment method and, more particularly, to, for example, a printing apparatus to which a printhead incorporating an element substrate with a plurality of print elements is applied to perform printing in accordance with an inkjet method, and a discharge status judgment method.

Description of the Related Art

One of inkjet printing methods of discharging ink droplets from nozzles and adhering them to a paper sheet, a plastic film, or another print medium uses a printhead with print elements that generate thermal energy to discharge ink. As for a printhead according to this method, an electrothermal transducer that generates heat in accordance with supply of an electric current, a drive circuit for it, and the like can be formed using the same process as a semiconductor manufacturing process. Therefore, this has the advantage in that high density implementation of nozzles is easy and higher-resolution printing can be achieved.

In this printhead, an ink discharge failure may occur in all or some of the nozzles of the printhead due to a factor such as clogging of a nozzle caused by a foreign substance or ink whose viscosity increases, bubbles trapped in an ink supply channel or a nozzle, or a change in wettability on a nozzle surface. To avoid degradation in image quality caused when such discharge failure occurs, a recovery operation of recovering an ink discharge status and a complementary operation by other nozzles are preferably, quickly executed. However, to execute these operations quickly, it is very important to correctly and appropriately judge the ink discharge status and the occurrence of the discharge failure.

Taking this background into consideration, there are conventionally proposed various ink discharge status judgment methods and complementary printing methods, and apparatuses to which these methods are applied.

Japanese Patent Laid-Open No. 2008-000914 discloses a method of detecting a decrease in temperature at the time of normal discharge to detect a failure of ink discharge from a printhead. According to Japanese Patent Laid-Open No. 2008-000914, at the time of normal discharge, a point (feature point) at which a temperature drop rate changes appears after a predetermined time elapses after the time when a detected temperature reaches a highest temperature, but no such point appears at the time of a discharge failure. Therefore, the ink discharge status is judged by detecting the presence/absence of the feature point. Furthermore, Japanese Patent Laid-Open No. 2008-000914 discloses an arrangement in which a temperature detection element is provided immediately below a print element that generates thermal energy for ink discharge, and discloses, as a method of detecting the presence/absence of the feature point, a method of detecting the feature point as a peak value by differential processing of a change in temperature.

The discharge status judgment method disclosed in Japanese Patent Laid-Open No. 2008-000914 assumes the arrangement in which the temperature detection element is provided immediately below the print element that generates thermal energy for ink discharge. Thus, the sensitivity of the temperature detection element changes due to a temporal change in resistance value of the temperature detection element, which is caused by the influence of heat generated at the time of ink discharge or a change in status of a protection film for protecting the print element, which is caused by repeating an ink discharge operation. This means that the detected temperature of the temperature detection element varies in accordance with the use of the print element. As a result of the variation, it is assumed that it becomes impossible to judge the ink discharge status correctly.

SUMMARY OF THE INVENTION

Accordingly, the present invention is conceived as a response to the above-described disadvantages of the conventional art.

For example, a printing apparatus and a discharge status judgment method according to this invention are capable of, for example, judging an ink discharge status correctly even if the sensitivity of a temperature detection element changes due to the use of a print element.

According to one aspect of the present invention, there is provided a printing apparatus comprising: a printhead including a plurality of nozzles each configured to discharge ink, a plurality of heaters respectively provided in the plurality of nozzles and each configured to heat the ink, a plurality of temperature detection elements provided in correspondence with the plurality of heaters, and an inspection circuit configured to inspect ink discharge statuses of the plurality of nozzles based on temperature detection results obtained by using the plurality of temperature detection elements: an inspection unit configured to cause the printhead to inspect an ink discharge status by selecting, from the plurality of nozzles of the printhead, a nozzle as a target of inspection of the ink discharge status, setting a threshold value for inspecting a temperature detection result of one of the plurality of temperature detection elements corresponding to the selected nozzle for inspection of the selected nozzle, and using the inspection circuit and the set threshold value; a reception unit configured to receive, from the printhead, an inspection result obtained by inspecting the ink discharge status using the threshold value for the nozzle selected by the inspection unit; a determination unit configured to determine, based on the inspection result received by the reception unit, a threshold value to be used by the inspection circuit for inspecting the discharge status of the selected nozzle in a subsequent inspection; and a storage unit configured to store the threshold value determined by the determination unit.

According to another aspect of the present invention, there is provided a discharge status judgment method for a printing apparatus comprising a printhead including a plurality of nozzles each configured to discharge ink, a plurality of heaters respectively provided in the plurality of nozzles and each configured to heat the ink, a plurality of temperature detection elements provided in correspondence with the plurality of heaters, and an inspection circuit configured to inspect ink discharge statuses of the plurality of nozzles based on temperature detection results obtained by using the plurality of temperature detection elements, the method comprising: inspecting, by the printhead, an ink discharge status by selecting, from the plurality of nozzles of the printhead, a nozzle as a target of inspection of the ink discharge status, setting a threshold value for judging a temperature detection result of one of the plurality of temperature detection elements corresponding to the selected nozzle for inspection of the selected nozzle, and using the inspection circuit and the set threshold value; receiving, from the printhead, an inspection result obtained by inspecting the ink discharge status using the threshold value for the selected nozzle; determining, based on the received inspection result, a threshold value to be used by the inspection circuit for inspecting the discharge status of the selected nozzle in a subsequent inspection; and storing the determined threshold value in a memory.

The invention is particularly advantageous since it is possible to judge an ink discharge status correctly even if the sensitivity of a temperature detection element changes due to the use of a print element.

Further features of the present invention will become apparent from the following description of exemplary embodiments with reference to the attached drawings.

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, unless otherwise specified, and a "print element" is provided in correspondence to an orifice, and means an element for generating energy used to discharge ink. For example, the print element may be provided in a position opposing to the orifice.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Printing Apparatus Mounted with Full-Line Printhead (FIG. 1)>

Figure 1:
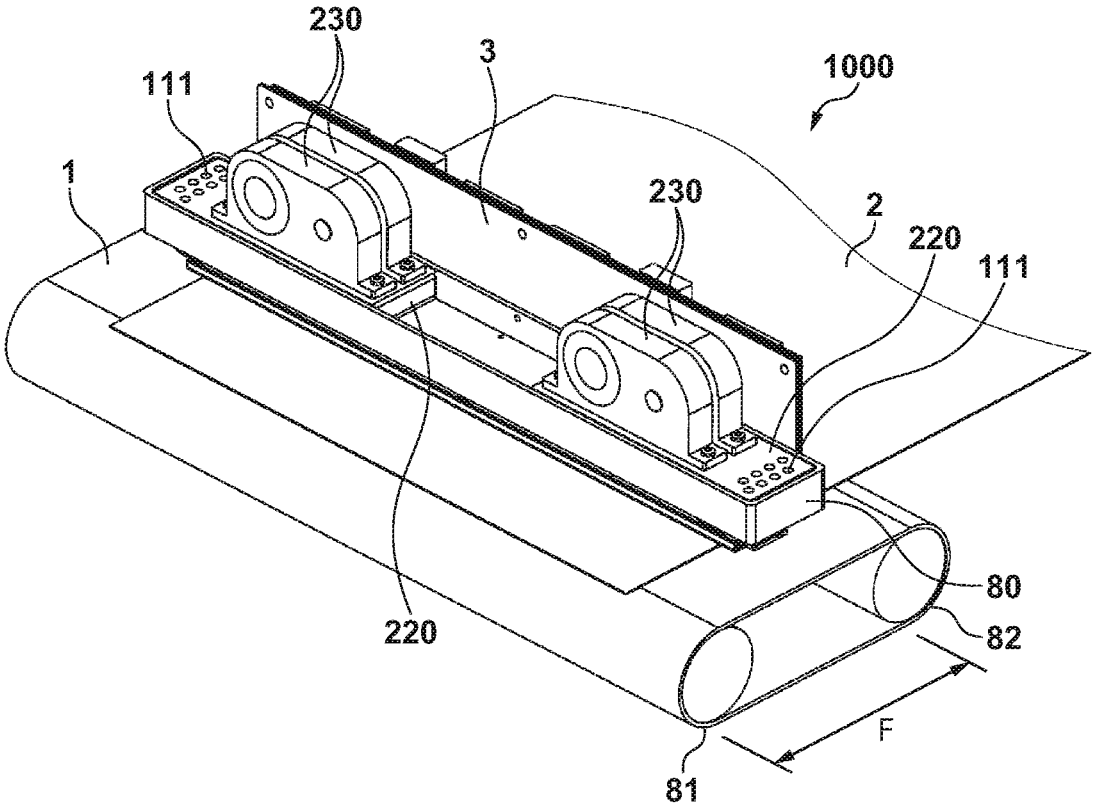
FIG. 1 is a perspective view for explaining the structure of a printing apparatus including a full-line printhead according to an exemplary embodiment of the present invention.

FIG. 1 is a perspective view showing the schematic arrangement of a printing apparatus 1000 using a full-line printhead that performs printing by discharging ink according to an exemplary embodiment of the present invention.

As shown in FIG. 1, the printing apparatus 1000 is a line type printing apparatus that includes a conveyance unit 1 that conveys a print medium 2 and a full-line printhead 3 arranged to be approximately orthogonal to the conveyance direction of the print medium 2, and performs continuous printing while conveying the plurality of print media 2 continuously or intermittently. The full-line printhead 3 includes ink orifices arrayed in a direction intersecting the conveyance direction of the printing medium. The full-line printhead 3 is provided with a negative pressure control unit 230 that controls the pressure (negative pressure) in an ink channel, a liquid supply unit 220 that communicates with the negative pressure control unit 230, and a liquid connecting portion 111 that serves as an ink supply and discharge port to the liquid supply unit 220.

A housing 80 is provided with the negative pressure control unit 230, the liquid supply unit 220, and the liquid connecting portion 111.

Note that the print medium 2 is not limited to a cut sheet, and may be a continuous roll sheet.

The full-line printhead (to be referred to as the printhead hereinafter) 3 can perform full-color printing by cyan (C), magenta (M), yellow (Y), and black (K) inks. A main tank and the liquid supply unit 220 serving as a supply channel for supplying ink to the printhead 3 are connected to the printhead 3. An electric controller (not shown) that transmits power and a discharge control signal to the printhead 3 is electrically connected to the printhead 3.

The print medium 2 is conveyed by rotating two conveyance rollers 81 and 82 provided apart from each other by a distance of F in the conveyance direction of the print medium 2.

The printhead 3 according to this embodiment employs the inkjet method of discharging ink using thermal energy. Therefore, each orifice of the printhead 3 includes an electrothermal transducer (heater). The electrothermal transducer is provided in correspondence with each orifice. When a pulse voltage is applied to the corresponding electrothermal transducer in accordance with a print signal, ink is heated and discharged from the corresponding orifice. Note that the printing apparatus is not limited to the above-described printing apparatus using the full-line printhead whose printing width corresponds to the width of the print medium. For example, the present invention is also applicable to a so-called serial type printing apparatus that mounts, on a carriage, a printhead in which orifices are arrayed in the conveyance direction of the print medium and performs printing by discharging ink to the print medium while reciprocally scanning the carriage.

<Explanation of Control Arrangement (FIG. 2)>

Figure 2:
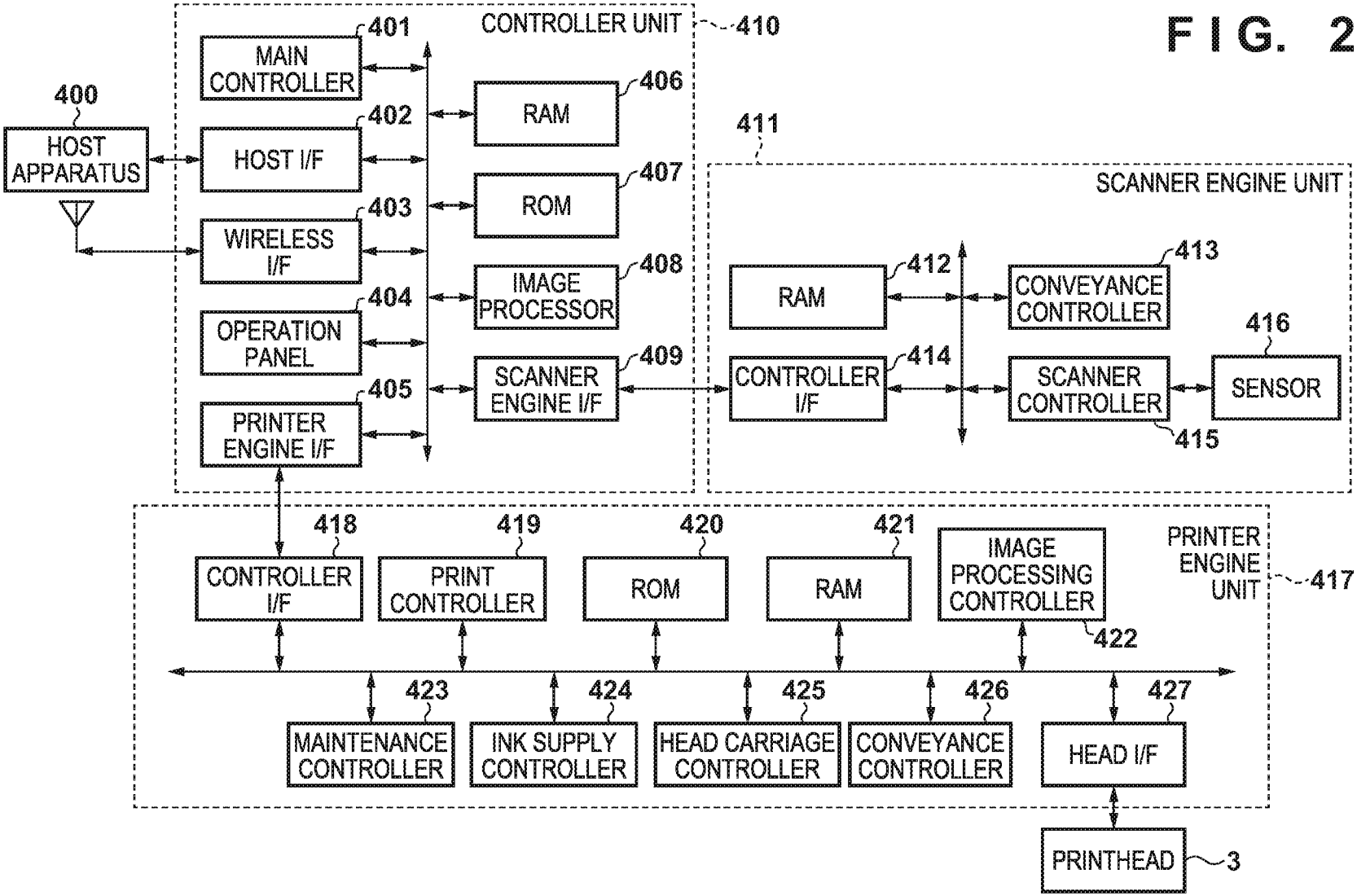
FIG. 2 is a block diagram showing the control arrangement of the printing apparatus shown in FIG. 1.

FIG. 2 is a block diagram showing the arrangement of the control circuit of the printing apparatus 1000.

As shown in FIG. 2, the printing apparatus 1000 is formed by a printer engine unit 417 that mainly controls a printing unit, a scanner engine unit 411 that controls a scanner unit, and a controller unit 410 that controls the overall printing apparatus 1000. A print controller 419 integrating an MPU and a non-volatile memory (EEPROM or the like) controls various mechanisms of the printer engine unit 417 in accordance with an instruction from a main controller 401 of the controller unit 410. The various mechanisms of the scanner engine unit 411 are controlled by the main controller 401 of the controller unit 410.

Details of the control arrangement will be described below.

In the controller unit 410, the main controller 401 formed by a CPU controls the overall printing apparatus 1000 by using a RAM 406 as a work area in accordance with a program and various parameters stored in a ROM 407. For example, if a print job is input from a host apparatus 400 via a host I/F 402 or a wireless I/F 403, an image processor 408 performs predetermined image processing for received image data in accordance with an instruction from the main controller 401. The main controller 401 transmits, to the printer engine unit 417 via a printer engine I/F 405, the image data having undergone the image processing.

Note that the printing apparatus 1000 may obtain image data from the host apparatus 400 via wireless or wired communication, or obtain image data from an external storage device (USB memory or the like) connected to the printing apparatus 1000. A communication method used for wireless or wired communication is not limited. For example, as a communication method used for wireless communication, Wi-Fi (Wireless Fidelity)® or Bluetooth® is applicable. Furthermore, as a communication method used for wired communication, USB (Universal Serial Bus) or the like is applicable. For example, if a read command is input from the host apparatus 400, the main controller 401 transmits the command to the scanner engine unit 411 via a scanner engine I/F 409.

An operation panel 404 is a unit used by the user to perform an input/output operation for the printing apparatus 1000. The user can instruct an operation such as a copy or scan operation via the operation panel 404, set a print mode, and recognize information from the printing apparatus 1000.

In the printer engine unit 417, the print controller 419 formed by a CPU controls the various mechanisms of the printer engine unit 417 by using a RAM 421 as a work area in accordance with a program and various parameters stored in a ROM 420.

Upon receiving various commands or image data via a controller I/F 418, the print controller 419 temporarily saves the received data in the RAM 421. So as to use the printhead 3 for a print operation, the print controller 419 causes an image processing controller 422 to convert the saved image data into print data. When the print data is generated, the print controller 419 causes, via a head I/F 427, the printhead 3 to execute a print operation based on the print data. At this time, the print controller 419 drives the conveyance rollers 81 and 82 via a conveyance controller 426 to convey the print medium 2. In accordance with an instruction from the print controller 419, a print operation is executed by the printhead 3 in synchronism with the conveyance operation of the print medium 2, thereby performing print processing.

A head carriage controller 425 changes the orientation and position of the printhead 3 in accordance with an operation status such as the maintenance status or print status of the printing apparatus 1000. An ink supply controller 424 controls the liquid supply unit 220 so that the pressure of ink supplied to the printhead 3 falls within an appropriate range. A maintenance controller 423 controls the operation of a cap unit or wiping unit in a maintenance unit (not shown) when performing a maintenance operation for the printhead 3.

In the scanner engine unit 411, the main controller 401 controls the hardware resources of a scanner controller 415 by using the RAM 406 as a work area in accordance with a program and various parameters stored in the ROM 407. This controls the various mechanisms of the scanner engine unit 411. For example, the main controller 401 controls the hardware resources in the scanner controller 415 via a controller I/F 414, and conveys, via a conveyance controller 413, a document stacked on an ADF (not shown) by the user, thereby reading the document by a sensor 416. Then, the scanner controller 415 saves read image data in a RAM 412.

Note that the print controller 419 can cause the printhead 3 to execute a print operation based on the image data read by the scanner controller 415 by converting, into print data, the image data obtained as described above.

<Explanation of Arrangement of Temperature Detection Element (FIGS. 3A to 3C)>

Figures 3A, 3B, 3C:
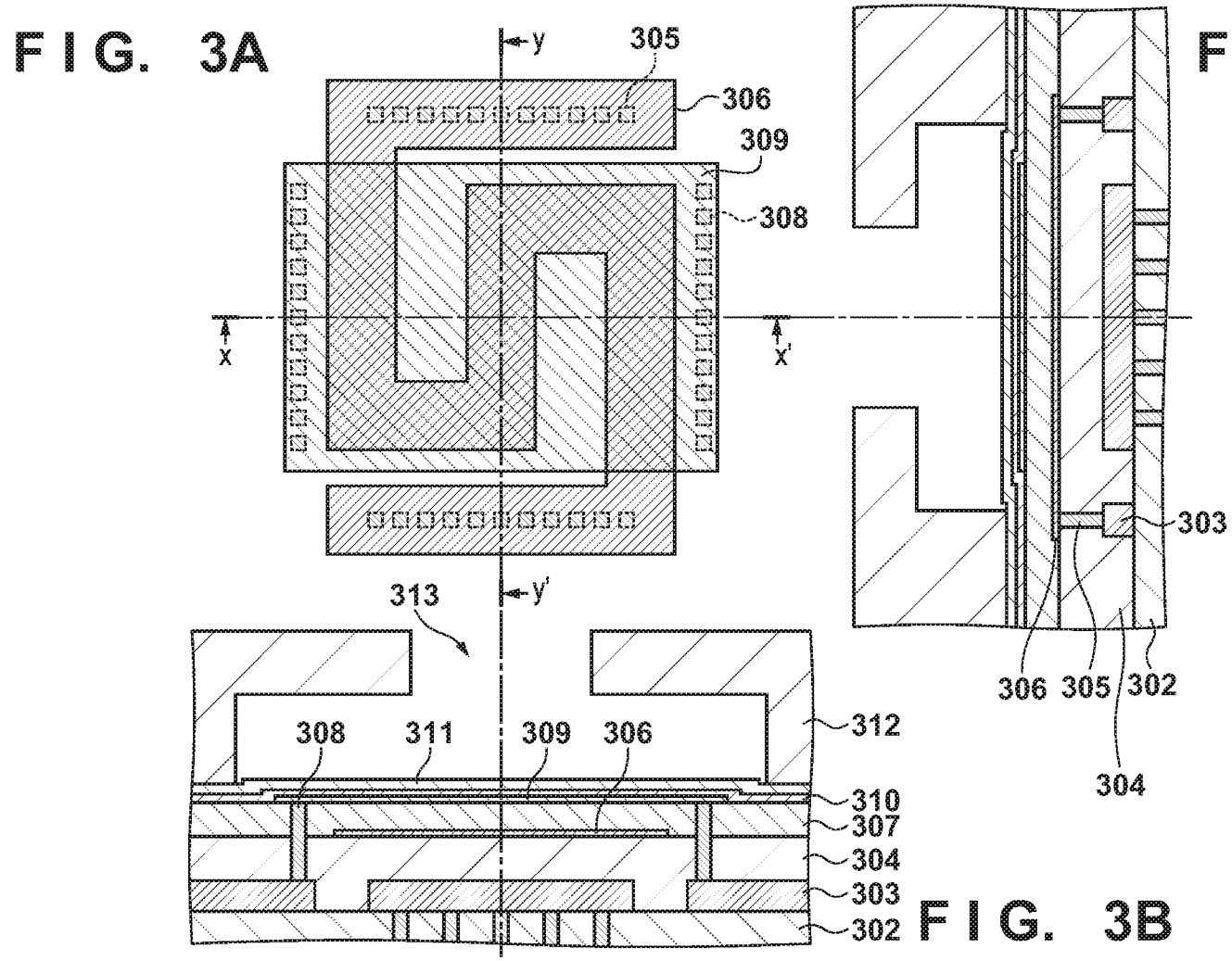
FIGS. 3A, 3B, and 3C are views each showing the multilayer wiring structure near a print element formed on a silicon substrate.

FIGS. 3A to 3C are views each showing the multilayer wiring structure near a print element formed on a silicon substrate.

FIG. 3A is a plan view showing a state in which a temperature detection element 306 is arranged in the form of a sheet in a layer below a print element 309 via an interlayer insulation film 307. FIG. 3B is a sectional view taken along a broken line x-x' in the plan view shown in FIG. 3A. FIG. 3C is another sectional view taken along a broken line y-y' shown in FIG. 3A.

In the x-x' sectional view shown in FIG. 3B and the y-y' sectional view shown in FIG. 3C, a wiring 303 made of aluminum or the like is formed on an insulation film 302 layered on the silicon substrate, and an interlayer insulation film 304 is further formed on the wiring 303. The wiring 303 and the temperature detection element 306 serving as a thin film resistor formed from a layered film of titanium and titanium nitride or the like are electrically connected via conductive plugs 305 which are embedded in the interlayer insulation film 304 and made of tungsten or the like.

Next, the interlayer insulation film 307 is formed above the temperature detection element 306. The wiring 303 and the print element 309 serving as a heating resistor formed by a tantalum silicon nitride film or the like are electrically connected via conductive plugs 308 which penetrate through the interlayer insulation film 304 and the interlayer insulation film 307, and made of tungsten or the like.

Note that when connecting the conductive plugs in the lower layer and those in the upper layer, they are generally connected by sandwiching a spacer formed by an intermediate wiring layer. When applied to this embodiment, since the film thickness of the temperature detection element serving as the intermediate wiring layer is as small as about several ten nm, the accuracy of overetching control with respect to a temperature detection element film serving as the spacer is required in a via hole process. In addition, the thin film is also disadvantageous in pattern miniaturization of a temperature detection element layer. In consideration of this situation, in this embodiment, the conductive plugs which penetrate through the interlayer insulation film 304 and the interlayer insulation film 307 are employed.

To ensure the reliability of conduction in accordance with the depths of the plugs, in this embodiment, each conductive plug 305 which penetrates one interlayer insulation film has a bore of 0.4 μm, and each conductive plug 308 which penetrates two interlayer insulation films has a larger bore of 0.6 μm.

Next, a head substrate (element substrate) is obtained by forming a protection film 310 such as a silicon nitride film, and then forming an anti-cavitation film 311 that contains tantalum or the like on the protection film 310. Furthermore, an orifice 313 is formed by a nozzle forming material 312 containing a photosensitive resin or the like.

As described above, the multilayer wiring structure in which an independent intermediate layer of the temperature detection element 306 is provided between the layer of the wiring 303 and the layer of the print element 309 is employed.

With the above arrangement, in the element substrate used in this embodiment, it is possible to obtain, for each print element, temperature information by the temperature detection element provided in correspondence with each print element.

Based on the temperature information detected by the temperature detection element and a change in temperature, a logic circuit (inspection circuit) provided in the element substrate can obtain a judgment result signal RSLT indicating the status of ink discharge from the corresponding print element. The judgment result signal RSLT is a 1-bit signal, and "1" indicates normal discharge and "0" indicates a discharge failure.

<Explanation of Temperature Detection Arrangement (FIG. 4)>

Figure 4:
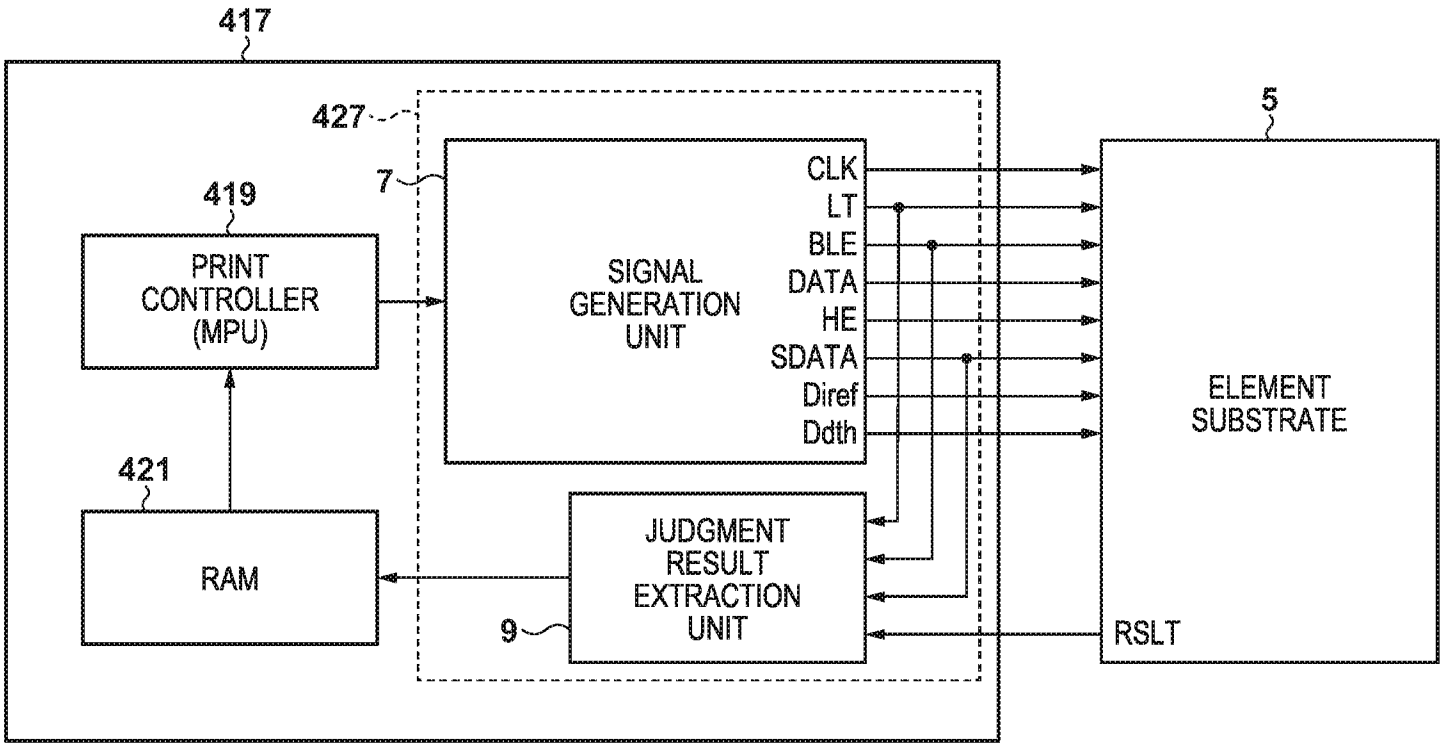
FIG. 4 is a block diagram showing a temperature detection control arrangement using the element substrate shown in FIGS. 3A, 3B, and 3C.

FIG. 4 is a block diagram showing a temperature detection control arrangement using the element substrate shown in FIGS. 3A to 3C.

As shown in FIG. 4, to detect the temperature of the print element integrated in an element substrate 5, the printer engine unit 417 includes the print controller 419 integrating the MPU, the head I/F 427 for connection to the printhead 3, and the RAM 421. Furthermore, the head I/F 427 includes a signal generation unit 7 that generates various signals to be transmitted to the element substrate 5, and a judgment result extraction unit 9 that receives the judgment result signal RSLT output from the element substrate 5 based on the temperature information detected by the temperature detection element 306.

For temperature detection, when the print controller 419 issues an instruction to the signal generation unit 7, the signal generation unit 7 outputs a clock signal CLK, a latch signal LT, a block signal BLE, a print data signal DATA, and a heat enable signal HE to the element substrate 5. The signal generation unit 7 also outputs a sensor selection signal SDATA, a constant current signal Diref, and a discharge inspection threshold signal Ddth.

The sensor selection signal SDATA includes selection information for selecting the temperature detection element to detect the temperature information, energization quantity designation information to the selected temperature detection element, and information pertaining to an output instruction of the judgment result signal RSLT. If, for example, the element substrate 5 is configured to integrate five print element arrays each including a plurality of print elements, the selection information included in the sensor selection signal SDATA includes array selection information for designating an array and print element selection information for designating a print element of the array. On the other hand, the element substrate 5 outputs the 1-bit judgment result signal RSLT based on the temperature information detected by the temperature detection element corresponding to the one print element of the array designated by the sensor selection signal SDATA.

A value of "1" indicating normal discharge and a value of "0" indicating a discharge failure, which are output from the judgment result signal RSLT, are obtained by comparing, in the element substrate 5, the temperature information output from the temperature detection element and discharge inspection threshold voltage (TH) indicated by the discharge inspection threshold signal Ddth. This comparison processing will be described in detail later.

Note that this embodiment employs an arrangement in which the 1-bit judgment result signal RSLT is output for the print elements of the five arrays. Therefore, in an arrangement in which the element substrate 5 integrates 10 print element arrays, the judgment result signal RSLT is a 2-bit signal, and this 2-bit signal is serially output to the judgment result extraction unit 9 via one signal line.

As is apparent from FIG. 4, the latch signal LT, the block signal BLE, and the sensor selection signal SDATA are fed back to the judgment result extraction unit 9. On the other hand, the judgment result extraction unit 9 receives the judgment result signal RSLT output from the element substrate 5 based on the temperature information detected by the temperature detection element, and extracts a judgment result during each latch period in synchronism with the fall of the latch signal LT. If the judgment result indicates a discharge failure, the block signal BLE and the sensor selection signal SDATA corresponding to the judgment result are stored in the RAM 421.

The print controller 419 erases a signal for the discharge failure nozzle from the print data signal DATA of a corresponding block based on the block signal BLE and the sensor selection signal SDATA which have been used to drive the discharge failure nozzle and stored in the RAM 421. The print controller 419 adds a nozzle for complementing a non-discharge nozzle to the print data signal DATA of the corresponding block instead, and outputs the signal to the signal generation unit 7.

<Explanation of Discharge Status Judgment Method (FIGS. 5 to 6C)>

Figure 5:
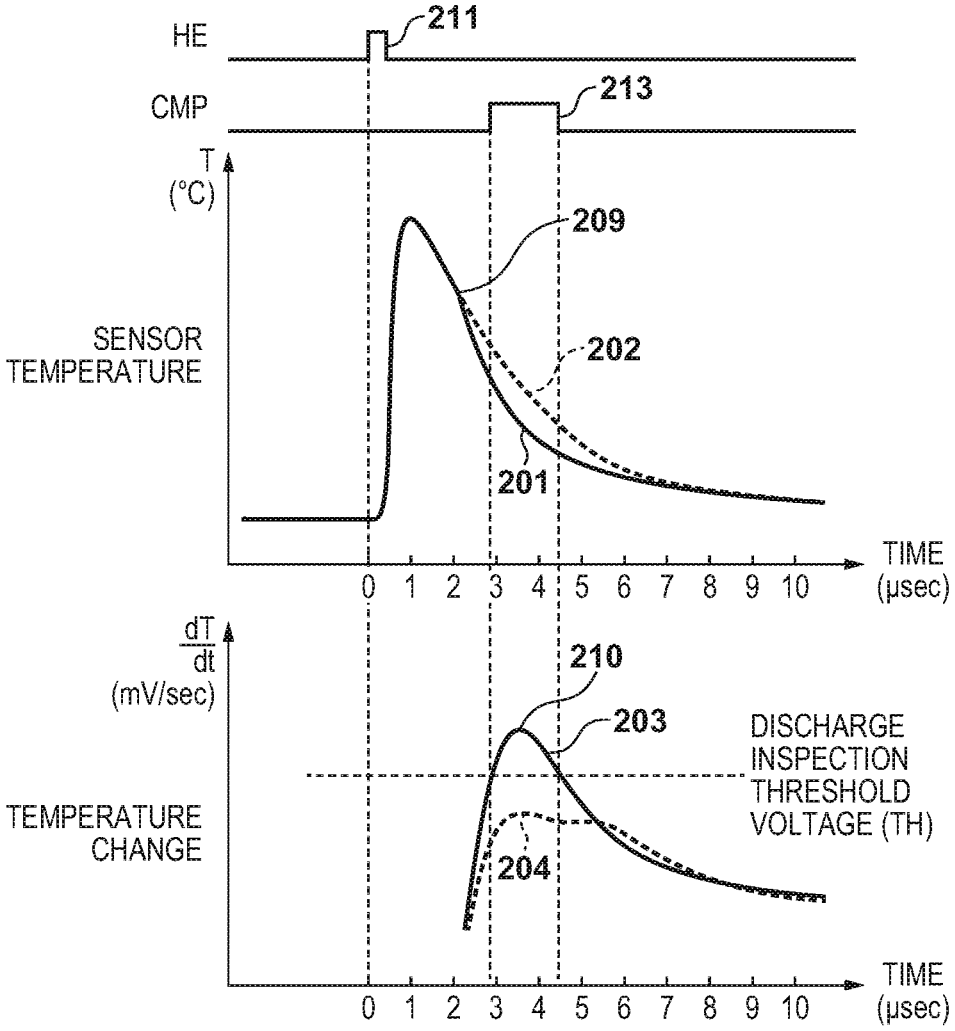
FIG. 5 is a view showing a temperature waveform output from a temperature detection element and a temperature change signal of the waveform when applying a drive pulse to the print element.

FIG. 5 is a view showing a temperature waveform (sensor temperature: T) output from a temperature detection element and a temperature change signal (dT/dt) of the waveform when applying a drive pulse to the print element.

Note that in FIG. 5, the temperature waveform (sensor temperature: T) is represented by a temperature (° C.). In fact, a constant current is supplied to the temperature detection element and a voltage (V) between the terminals of the temperature detection element is detected. Since this detected voltage has temperature dependence, the detected voltage is converted into a temperature and indicated as the temperature in FIG. 5. The temperature change signal (dT/dt) is indicated as a temporal change (mV/sec) in detected voltage.

As shown in FIG. 5, if ink is discharged normally when a driving pulse 211 is applied to the print element 309

(normal discharge), a waveform 201 is obtained as the output waveform of the temperature detection element 306. In a temperature drop process of the temperature detected by the temperature detection element 306, which is represented by the waveform 201, a feature point 209 appears when the tail (satellite) of an ink droplet discharged from the print element 309 drops to the interface of the print element 309 and cool the interface at the time of normal discharge. After the feature point 209, the waveform 201 indicates that the temperature drop rate increases abruptly. On the other hand, at the time of a discharge failure, a waveform 202 is obtained as the output waveform of the temperature detection element 306. Unlike the waveform 201 at the time of normal discharge, no feature point 209 appears, and the temperature drop rate gradually decreases in a temperature drop process.

The lowermost timing chart of FIG. 5 shows the temperature change signal (dT/dt), and a waveform 203 or 204 represents a waveform obtained after processing the output waveform 201 or 202 of the temperature detection element into the temperature change signal (dT/dt). A method of performing conversion into the temperature change signal at this time is appropriately selected in accordance with a system. The temperature change signal (dT/dt) according to this embodiment is represented by a waveform output after the temperature waveform is processed by a filter circuit (one differential operation in this arrangement) and an inverting amplifier.

In the waveform 203, a peak 210 deriving from the highest temperature drop rate after the feature point 209 of the waveform 201 appears. The waveform (dT/dt) 203 is compared with a discharge inspection threshold voltage (TH) preset in a comparator integrated in the element substrate 5, and a pulse indicating normal discharge in a period (dT/dt≥TH) in which the waveform 203 exceeds the discharge inspection threshold voltage (TH) appears in a judgment signal (CMP) 213.

On the other hand, since no feature point 209 appears in the waveform 202, the temperature drop rate is low, and the peak appearing in the waveform 204 is lower than the discharge inspection threshold voltage (TH). The waveform (dT/dt) 202 is also compared with the discharge inspection threshold voltage (TH) preset in the comparator integrated in the element substrate 5. In a period (dT/dt<TH) in which the waveform 202 is below the discharge inspection threshold voltage (TH), no pulse appears in the judgment signal (CMP) 213.

Therefore, by obtaining this judgment signal (CMP), it is possible to grasp the discharge status of each nozzle. This judgment signal (CMP) serves as the above-described judgment result signal RSLT.

Problem of Judgment of Discharge Status

Figure 6A:
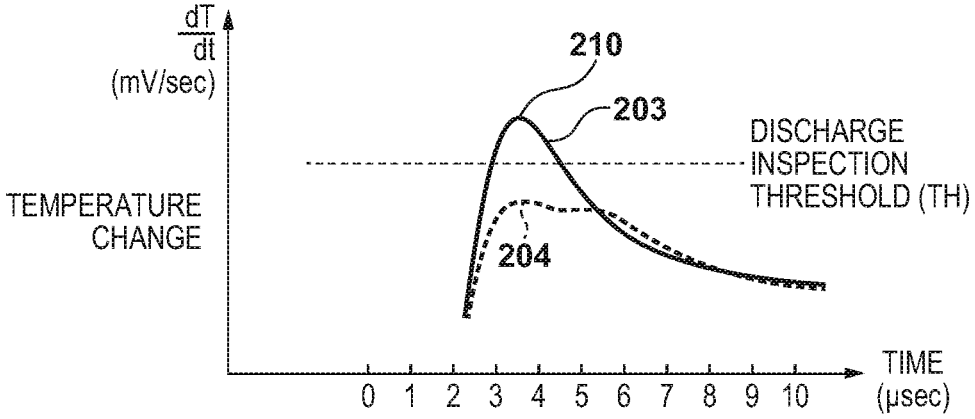
FIGS. 6A, 6B, and 6C are timing charts each showing the waveform of the temperature change signal (dT/dt) based on the temperature waveform signal detected by the temperature detection element.
Figure 6B:
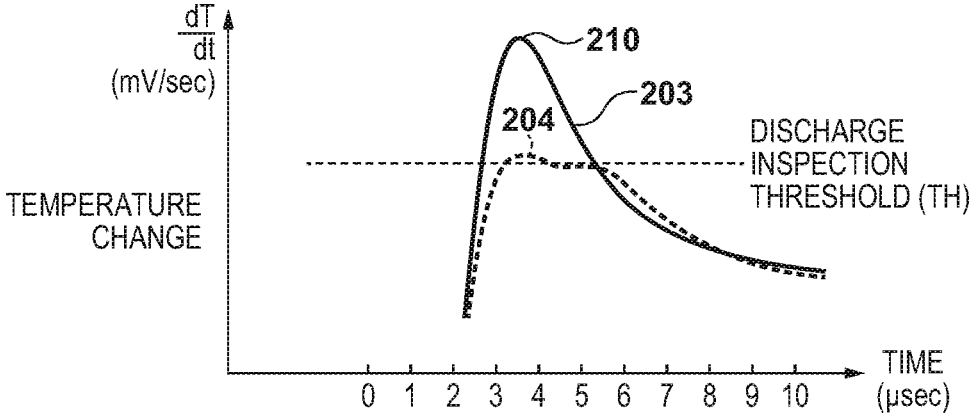
Figure 6C:
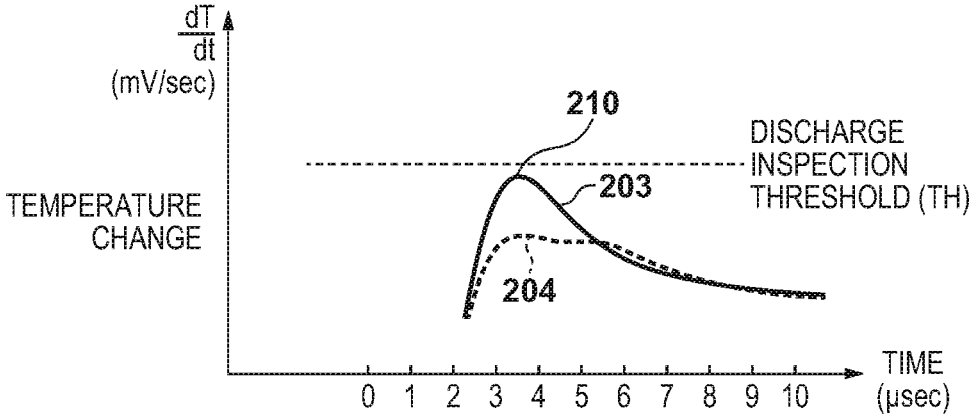

FIGS. 6A to 6C are timing charts each showing the waveform of the temperature change signal (dT/dt) based on the temperature waveform signal detected by the temperature detection element.

FIG. 6A is a timing chart showing the profile of the temperature change when discharge judgment is performed correctly. The discharge inspection threshold voltage (TH) is set between the waveform 203 at the time of normal discharge and the waveform 204 at the time of a discharge failure. Therefore, by comparing the discharge inspection threshold voltage (TH) and the temperature change signal (dT/dt) with each other, the discharge status can be discriminated correctly.

As described above, the element substrate employs an arrangement in which the temperature detection element is provided immediately below the print element serving as a heating resistor (electrothermal transducer). This causes a manufacturing variation of the temperature detection element, a temporal change in resistance value of the temperature detection element by the influence of heat generated at the time of ink discharge, deterioration of the protection film of the print element by repeating an ink discharge operation, and a change in sensitivity of the temperature detection element by deposition of pigment or polymer contained in ink. This indicates that the detected temperature of the temperature detection element varies in accordance with the use of each print element. As a result of the variation, it may be impossible to judge the ink discharge status correctly.

FIG. 6B shows an example of a case in which, as a result of the distance between the print element and the temperature detection element being relatively shorter due to deterioration of the protection film of the print element or the like, the sensitivity of detecting a change in temperature on the print element becomes high. In this case, even if the preset discharge inspection threshold voltage (TH) and the temperature change signal (dT/dt) are compared with each other, the value of the waveform 204 is higher than the discharge inspection threshold voltage (TH) and normal discharge is erroneously judged, although the print element is actually in a discharge failure status.

FIG. 6C shows an example in which when the pigment or polymer component of ink is adhered/deposited onto the print element to form a deposition layer on the print element, the sensitivity of detecting a change in temperature on the print element decreases. In this case, even if the preset discharge inspection threshold voltage (TH) and the temperature change signal (dT/dt) are compared with each other, the value of the waveform 203 is lower than the discharge inspection threshold voltage (TH) and a discharge failure is erroneously judged, although the print element is actually in a normal discharge status.

As described above, since the sensitivity of the temperature detection element changes in accordance with the use of each print element, it may become impossible to detect the discharge status correctly. In this embodiment, to solve this problem, a method of setting an appropriate discharge inspection threshold value even if the sensitivity of the temperature detection element changes for each print element will be described.

First Embodiment

After a description of an overview of discharge judgment processing, discharge inspection threshold value reset processing for preventing an erroneous judgment made due to a variation in discharge inspection threshold value caused by the use status of the print element, which is performed when discharge judgment processing using the temperature detection element is executed, will be described with reference to a flowchart shown in FIG. 8.

Figure 7:
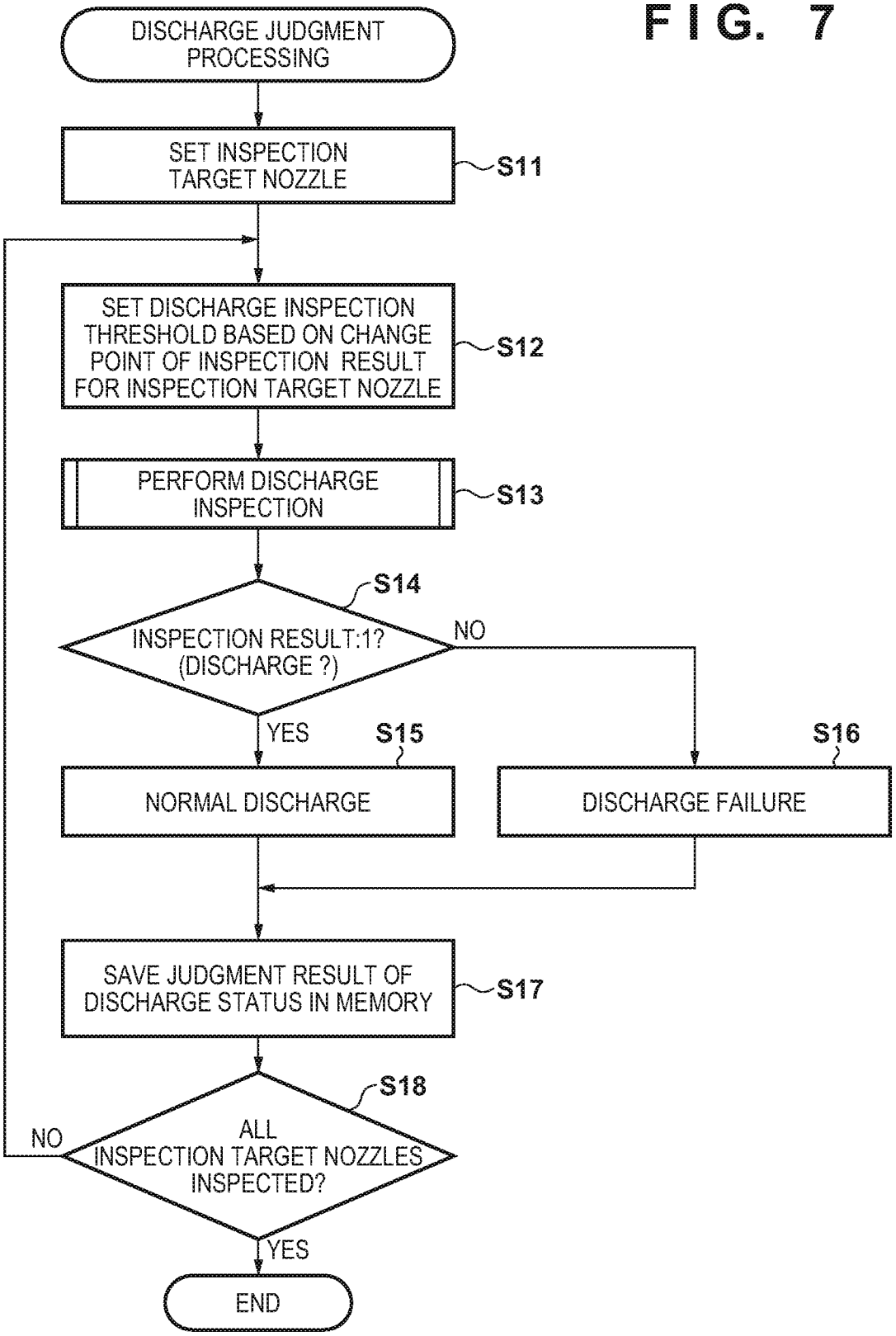
FIG. 7 is a flowchart illustrating an overview of discharge judgment processing.

FIG. 7 is a flowchart illustrating an overview of the discharge judgment processing. FIG. 8 is a flowchart illustrating the discharge inspection threshold value reset processing.

The discharge judgment processing shown in FIG. 7 is executed at any desired timing, and judges the discharge status of each nozzle at the time of execution of the processing.

In step S11, a print controller 419 instructs an inspection target nozzle (print element), and a signal generation unit 7 selects the inspection target nozzle by a sensor selection signal SDATA in accordance with the instruction. In step S12, a discharge inspection threshold voltage (TH) is set based on the change point of the current inspection result of the selected nozzle. As the discharge inspection threshold voltage (TH), a voltage lower than the change point of the inspection result by a predetermined amount is set in consideration of the characteristic of the temperature detection element, the ink characteristic, a detection error, a variation of repetitive inspection, the tolerable variation of the change point of the inspection result, an update frequency, and the like. This change point of the inspection result can be obtained by executing the discharge threshold value reset processing (to be described later), and is updated at each predetermined timing. The predetermined timing is set by a paper feeding count, a print dot count, time, an elapsed period after last inspection, a timing for each print job, a timing for each print page, a timing of replacement of the printhead, a timing of recovery processing of the printhead, or the like, and is set appropriately in accordance with a system.

In step S13, discharge inspection is executed by using the discharge inspection threshold voltage (TH) calculated based on the change point of the inspection result. In step S14, it is checked whether the discharge status of the selected nozzle is a normal discharge status or a discharge failure status. If a judgment result signal RSLT is "1", the process advances to step S15, and it is judged that the selected nozzle is in the normal discharge status. On the other hand, if the judgment result signal RSLT is "0", the process advances to step S16, and it is judged that the selected nozzle is in the discharge failure status.

In step S17, the discharge status of the selected nozzle is saved in a RAM 421. In step S18, it is checked whether all target nozzles have been inspected. If it is determined that inspection is to continue, the process returns to step S11 to select another inspection target nozzle, and then the processes in step S12 and the subsequent steps are executed. On the other hand, if it is determined that inspection is to end, the discharge judgment processing ends.

After that, image quality correction control, recovery processing, and the like are executed in accordance with the discharge status judgment result.

A method of specifying the change point of the inspection result of each nozzle necessary to reset the discharge inspection threshold value will be described next.

Figure 8:
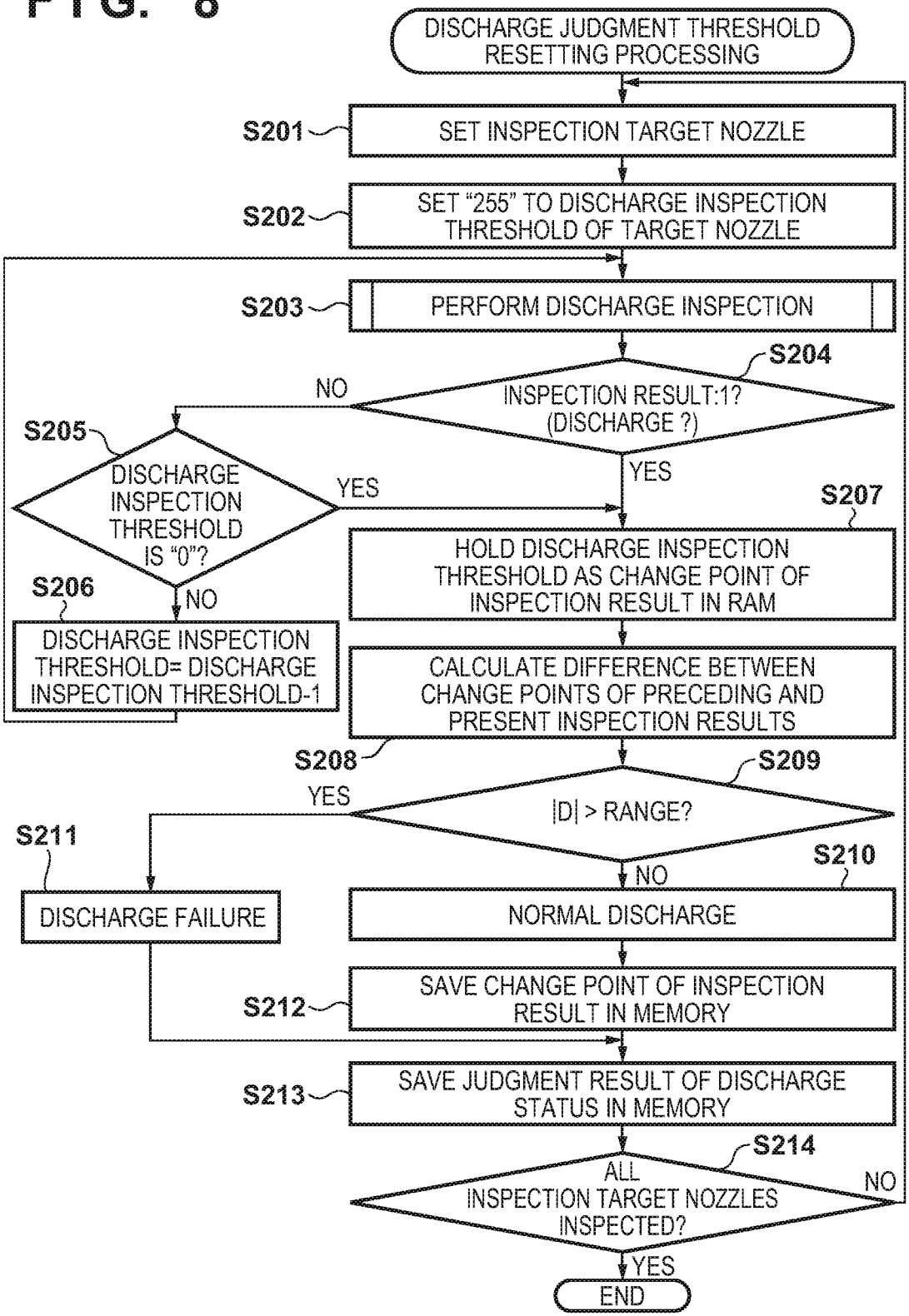
FIG. 8 is a flowchart illustrating processing of specifying a change point of an inspection result according to the first embodiment.

FIG. 8 is a flowchart illustrating the processing of specifying the change point of the inspection result.

In step S201, a target nozzle of the reset of the discharge inspection threshold value is set. This is done by performing the same processing as in step S11 of FIG. 7. Next, in step S202, the discharge inspection threshold voltage (TH) of the target nozzle is set to "255".

As is apparent from FIGS. 5 to 6C, the discharge inspection threshold voltage (TH) is compared with the temperature change (dT/dt) of the detected temperature output from the temperature detection element. The value of this temperature change is physically expressed in a unit of mV/sec. In this embodiment, however, this value is quantumly expressed by 8 bits. Thus, "255" as the maximum value of the 8-bit representation is temporarily set as the value of the discharge inspection threshold voltage (TH).

In step S203, discharge inspection is executed using the set discharge inspection threshold voltage (TH). The discharge inspection processing is the same as in step S13 of FIG. 7. In step S204, it is checked based on the set discharge inspection threshold voltage (TH) whether the discharge status of the selected nozzle is the normal discharge status or the discharge failure status. If the judgment result signal RSLT is "1", the process advances to step S207. If the judgment result signal RSLT is "0", the process advances to step S205. In step S205, it is checked whether the discharge inspection threshold voltage (TH) is "0", that is, the minimum value. If the discharge inspection threshold voltage (TH) is "0", the process advances to step S207; otherwise, the process advances to step S206 to decrement the value of discharge inspection threshold voltage (TH) by "1", and then returns to step S203.

As described above, in the processes of steps S203 to S206, discharge inspection is repeated for one selected nozzle while changing the value of the discharge inspection threshold voltage (TH), thereby specifying the change point of the inspection result at which the judgment result signal RSLT changes from "0" to "1". The change point of the inspection result is synonymous with the value of the peak of the temperature change waveform. In step S207, the value of the discharge inspection threshold voltage (TH) corresponding to the change point of the inspection result is temporarily saved in the RAM 421.

In this embodiment, as described above, the value of the discharge inspection threshold voltage can be set at 256 stages. Therefore, by executing discharge inspection at most 256 times for each nozzle, it is possible to specify the change points of the inspection results of all the nozzles.

In step S208, the discharge inspection threshold voltage (TH) corresponding to the change point of the last inspection result saved in advance in the non-volatile memory such as an EEPROM is read out, and the difference between the readout discharge inspection threshold voltage (TH) and the discharge inspection threshold voltage (TH) corresponding to the change point of the inspection result obtained in the current inspection processing is calculated. Furthermore, in step S209, it is checked whether the absolute value (|D|) of the calculated difference is larger than a predetermined range (RANGE). If $|D| \leq RANGE$, that is, the absolute value of the difference falls within the predetermined range, the process advances to step S210 to judge that the nozzle is in a normal discharge enable status, and then advances to step S212. On the other hand, if $|D| > RANGE$, that is, the absolute value of the difference falls outside the predetermined range, the process advances to step S211 to judge that the nozzle is in the discharge failure status, and then advances to step S213.

Note that the difference between the discharge inspection threshold voltages (TH) corresponding to the change points of the current and last inspection result is calculated but the present invention is not limited to this. As long as a difference can be used to judge the status of the nozzle in step S208, it is possible to calculate a difference in discharge inspection threshold voltages corresponding to the change points of the inspection results between the current inspection processing and predetermined past inspection processing instead of the last inspection processing. For example, a difference with respect to an inspection result before the last may be calculated. Alternatively, a difference from a representative value such as the maximum, minimum, or average value of the history of the change points of the past inspection results may be calculated.

As described above, the reason why the discharge status of each nozzle is judged based on the information about the change point of the specified inspection result is that the information about the change point of the inspection result of the specified nozzle needs to be a value obtained in the normal discharge status.

The above-described predetermined range is appropriately set in accordance with a system in consideration of the characteristic of the temperature detection element, the ink characteristic, a detection error, a variation of repetitive inspection, a tolerable variation, an update frequency, and the like. In this embodiment, a case in which the change point of the current inspection result is away from the last one by more than "−5" is set as a range for judging a discharge failure. The discharge status is judged based on a variation of the discharge inspection threshold voltage (TH) corresponding to the change point of the last inspection result of each nozzle. However, in the first inspection after replacement of the printhead, there is no information for the change point of the last inspection result, and thus the same processing is performed with reference to the information about the change point of the inspection result saved in advance in the non-volatile memory mounted on the printhead. This judges the discharge status for each nozzle. For a nozzle judged to be in the discharge failure status, prohibition of discharge is set to reduce degradation in image quality as much as possible, and the nozzle is processed as an image quality correction control target nozzle.

In step S212, for a nozzle judged to be in the normal discharge status, the value of the discharge inspection threshold voltage (TH) is determined as a new discharge inspection threshold voltage (TH) based on the change point of the inspection result in the RAM 421. As the discharge inspection threshold voltage (TH), a voltage lower than the change point of the inspection result by a predetermined amount is set in consideration of the characteristic of the temperature detection element, the ink characteristic, a detection error, a variation of repetitive inspection, the tolerable variation of the change point of the inspection result, an update frequency, and the like. If the discharge inspection threshold voltage has a value of 255, a value lower than the voltage corresponding to the change point of the inspection result by about 5 is set. Note that the value of the discharge inspection threshold voltage (TH) corresponding to the change point of the inspection result may be determined as a new discharge inspection threshold voltage.

Then, update processing is performed using the new discharge inspection threshold voltage so as to judge the next discharge status based on this value. At this time, the updated value may be restricted in accordance with the value of the discharge inspection threshold voltage corresponding to the change point of the inspection result. Furthermore, as for the discharge inspection threshold voltage corresponding to the change point of the inspection result for the nozzle judged to be in the discharge failure status, the last value is continuously held without performing update processing, and the next discharge status is judged based on this value.

In step S213, the discharge status judgment result saved in the EEPROM is updated by the discharge status judgment result of each nozzle, and used for the above-described image quality correction control or the like.

Lastly, in step S214, it is checked whether all the target nozzles have been inspected. If it is determined to continue inspection, the process returns to step S201 to select another inspection target nozzle, and then the processes in step S202 and the subsequent steps are executed. On the other hand, if it is determined to end inspection, the discharge judgment threshold value reset processing ends.

Therefore, according to the above-described embodiment, each nozzle is inspected at each predetermined timing to check whether the change point of the inspection result varies, thereby resetting an appropriate discharge inspection threshold voltage for each nozzle. Thus, even if the characteristic of the print element or the temperature detection element changes due to a different use status of each print element, it is possible to correctly judge the discharge status of each print element, and always perform satisfactory image printing.

Second Embodiment

The first embodiment has explained an example of executing discharge inspection for all settable stages (in this example, 256 stages) of the inspection threshold value and specifying a change point of an inspection result. However, the inspection time tends to be long. This embodiment will describe an example of shortening the time until a change point of an inspection result is specified.

Figure 9:
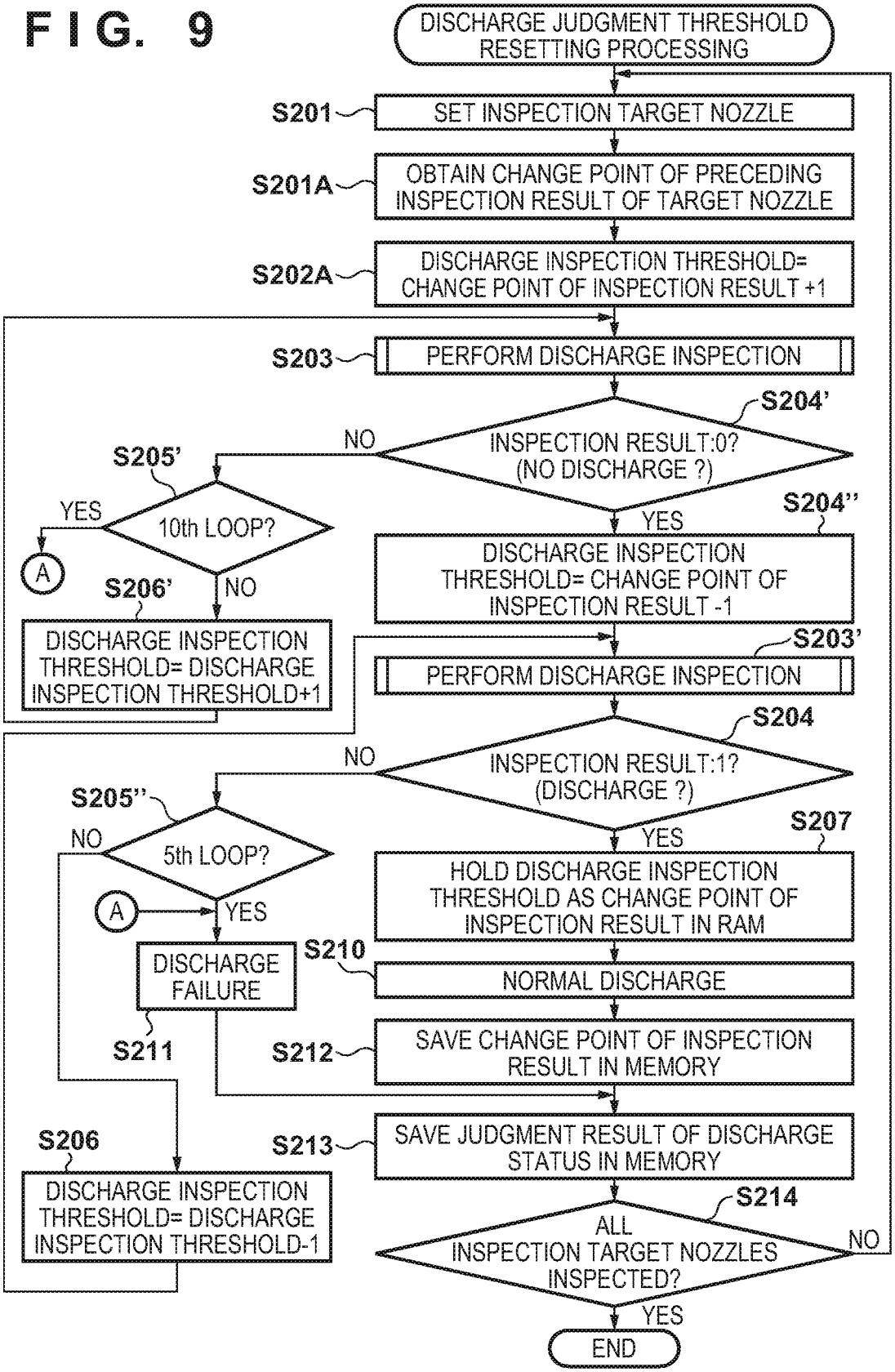
FIG. 9 is a flowchart illustrating discharge inspection threshold value reset processing according to the second embodiment.

FIG. 9 is a flowchart illustrating processing of resetting a discharge inspection threshold voltage. Note that in FIG. 9, the same step numbers as those already described with reference to FIG. 8 denote the same processing steps, and a description thereof will be omitted. Only processing steps unique to this embodiment will be described.

After step S201, in step S201A, a discharge inspection threshold voltage (TH) corresponding to a change point of a last inspection result saved in advance in a non-volatile memory such as an EEPROM is read out. In step S202A, a discharge inspection threshold voltage (TH) of a target nozzle is set to a value obtained by incrementing the value obtained in step S201A by "1". The reason why the value is set in this way is that the change point of the inspection result is highly probably near the change point of the last inspection result.

After that, in step S203, discharge inspection is executed using the set discharge inspection threshold voltage (TH). In step S204', it is checked based on the set discharge inspection threshold voltage (TH) whether the discharge status of the selected nozzle is a normal discharge status or a discharge failure status. If a judgment result signal RSLT is "0", the process advances to step S204". On the other hand, if the judgment result signal RSLT is "1", the process advances to step S205'. In step S205', it is checked whether the ordinal number of execution of discharge inspection in step S203 is 10. If the ordinal number of the execution of discharge inspection is 10, the process advances to step S211. If the ordinal number of the execution of discharge inspection is smaller than 10, the process advances to step S206' to increment the value of the discharge inspection threshold voltage (TH) by "1", and then returns to step S203.

As described above, in the processes of steps S203 and S204' to S206', it is checked whether a change point is found in the inspection result when increasing the value of the discharge inspection threshold voltage (TH) from the discharge inspection threshold voltage (TH) corresponding to the change point of the last inspection result within a predetermined range.

Next, in step S204", the discharge inspection threshold voltage (TH) of the target nozzle is set to a value obtained by decrementing the value obtained in step S201A by "1". Next, in step S203', discharge inspection is executed using the set discharge inspection threshold voltage (TH), similar to step S203. In step S204, it is checked based on the set discharge inspection threshold voltage (TH) whether the discharge status of the selected nozzle is the normal discharge status or the discharge failure status. If the judgment result signal RSLT is "1", the process advances to step S207. On the other hand, if the judgment result signal RSLT is "0", the process advances to step S205". In step S205", it is checked whether the ordinal number of execution of discharge inspection in step S203' is five. If the ordinal number of the execution of discharge inspection is five, the process advances to step S211. If the ordinal number of the execution of discharge inspection is smaller than five, the process advances to step S206 to decrement the value of the discharge inspection threshold voltage (TH) by "1", and then returns to step S203'.

As described above, in the processes of steps S203', S204, S205", and S206, it is checked whether a change point is found in the inspection result when decreasing the value of the discharge inspection threshold voltage (TH) from the discharge inspection threshold voltage (TH) corresponding to the change point of the last inspection result within a predetermined range.

With the above processing, by increasing/decreasing stepwise the value of the discharge inspection threshold voltage (TH) from the discharge inspection threshold voltage (TH) corresponding to the change point of the last inspection result within a predetermined range, it is possible to specify a discharge inspection threshold voltage at which the discharge judgment result changes. In this embodiment, a discharge failure is judged when it is impossible to specify a change point of an inspection result even by increasing the discharge inspection threshold voltage in 10 stages and decreasing the discharge inspection threshold voltage in five stages. Furthermore, in this embodiment, it is possible to obtain the difference from the discharge inspection threshold voltage corresponding to the change point of the last inspection result by counting the number of times the discharge inspection threshold voltage is changed stepwise, and the count value is restricted. Thus, it is possible to simultaneously judge whether the difference from the discharge inspection threshold voltage corresponding to the change point of the last inspection result falls within a predetermined range.

In steps S207 and S210 to S214, the same processes as those described in the first embodiment are performed.

Therefore, according to the above-described embodiment, since the discharge inspection threshold voltage corresponding to the change point of the last inspection result is set as a start point, and the change point of the inspection result is specified while changing the discharge inspection threshold voltage, it is possible to efficiently reset the discharge inspection threshold voltage of each nozzle. Therefore, as compared with the first embodiment, it is possible to specify the change point of the inspection result by two discharge inspection operations at minimum, thereby largely shortening the processing time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-062260, filed Mar. 28, 2018, which is hereby incorporated by reference herein in its entirety.

What is claimed is:

1. A printing apparatus comprising:

a printhead including a plurality of nozzles each configured to discharge a liquid, a plurality of energy generating elements respectively provided in the plurality of nozzles and each configured to generate energy used for discharging the liquid from the nozzle by application of a pulse signal, and a plurality of detection elements provided in correspondence with the plurality of energy generating elements, each detection element configured to detect information associated with a state of the liquid between a nozzle corresponding to the detection element and the energy generating corresponding to the detection element in a case in which the pulse signal is applied to the energy generating element corresponding to the detection element;

an inspection unit configured to inspect a discharge status of the liquid of a selected nozzle, from the plurality of nozzles of the printhead, as a target of inspection of the discharge status, by setting a threshold value for inspecting the discharge status of the selected nozzle based on the information detected by the detection element and the set threshold value;

a determination unit configured to determine, based on the inspection result obtained by inspecting the discharge status of the selected nozzle by the inspection unit, a threshold value to be used by the inspection unit for inspecting the discharge status of the selected nozzle in a subsequent inspection; and a storage unit configured to store the threshold value determined by the determination unit, wherein the inspection unit inspects the discharge status plural times by setting a plurality of different threshold values for the selected nozzle, and the determination unit determines, based on a plurality of inspection results that have been obtained from inspecting the discharge status plural times by setting the plurality of different threshold values and that have been obtained by the inspection unit, the threshold value to be used for inspecting the discharge status of the selected nozzle in the subsequent inspection.

2. The apparatus according to claim 1, wherein the inspection unit includes:

a signal generation unit configured to generate a selection signal for selecting, among the plurality of nozzles, a nozzle as a target of inspection of the discharge status and an inspection threshold signal indicating the threshold value, and output the selection signal and the inspection threshold signal to the printhead; and an instruction unit configured to issue an instruction to change the nozzle indicated by the selection signal generated by the signal generation unit and the threshold value indicated by the inspection threshold signal.

3. The apparatus according to claim 2, wherein the determination unit determines, as the threshold value for inspecting the discharge status of the nozzle selected by the selection signal, the threshold value indicated by the inspection threshold signal used when a change in an inspection result signal indicating the inspection result is obtained for the nozzle selected by the selection signal.

4. The apparatus according to claim 3, wherein the change in the inspection result signal indicates one of a change of the inspection result from normal discharge to discharge failure and a change of the inspection result from discharge failure to normal discharge.

5. The apparatus according to claim 2, wherein the instruction unit instructs nozzles as inspection targets of the inspection unit one by one.

6. The apparatus according to claim 5, wherein the instruction unit changes the threshold value by a predetermined value from a possible maximum value of the threshold value, each time a change is to be made.

7. The apparatus according to claim 5, wherein the instruction unit changes the threshold value by a predetermined value from a threshold value obtained in a last inspection and stored in the storage unit, each time a change is to be made.

8. The apparatus according to claim 7, further comprising a judgment unit configured to judge, if a difference between the threshold value and a threshold value obtained in a past inspection and stored in the storage unit is greater than a predetermined range, a discharge failure for the nozzle inspected by the inspection unit, and judge, if the difference falls within the predetermined range, a normal discharge status for the nozzle inspected by the inspection unit.

9. The apparatus according to claim 8, wherein based on a judgment result by the judgment unit, the storage unit further stores information indicating a nozzle in a normal discharge status and a nozzle in a discharge failure status.

10. The apparatus according to claim 1, wherein the inspection unit compares the threshold value indicated by the inspection threshold signal and the information associated with the state of the liquid between the nozzle and the energy generating element in a case in which the pulse signal is applied to the energy generating element, inspects the discharge status of the selected nozzle based on a result of the comparison, and outputs an inspection result.

11. The apparatus according to claim 1, wherein inspection by the inspection unit is performed at least at one of timings set by a paper feeding count, a print dot count, an elapsed period after last inspection, a timing of replacement of the printhead, a timing of recovery processing of the printhead, a timing for each print job, and a timing for each print page.

12. The apparatus according to claim 1, wherein the storage unit stores a plurality of thresholds corresponding to the plurality of nozzles, respectively.

13. The apparatus according to claim 1, wherein each of the energy generating elements comprises a heater for heating the liquid and configured to generate thermal energy, and wherein each of the detection elements detects temperature information used for inspection by the inspection unit.

14. The apparatus according to claim 13, wherein the temperature information indicates a temporal change in temperature obtained from the detection elements.

15. The apparatus according to claim 1, wherein liquid discharged by the printhead is ink.

16. The apparatus according to claim 1, wherein the inspection unit is a circuit included in the printhead.

17. A discharge status judgment method for a printing apparatus comprising a printhead including a plurality of nozzles each configured to discharge a liquid, a plurality of energy generating elements respectively provided in the plurality of nozzles and each configured to generate energy used for discharging the liquid from the nozzle by application of a pulse signal, a plurality of detection elements provided in correspondence with the plurality of energy generating elements, each detection element configured to detect information associated with a state of the liquid between a nozzle corresponding to the detection element and the energy generating element corresponding to the detection element in a case in which the pulse signal is applied to the energy generating element corresponding to the detection element, and an inspection unit configured to inspect liquid discharge statuses of the plurality of nozzles based on detection results obtained by using the plurality of detection elements, the method comprising:

inspecting, by the printhead, a discharge status of the liquid of a selected nozzle, from the plurality of nozzles of the printhead, as a target of inspection of the discharge status, by setting a threshold value for inspecting the discharge status of the selected nozzle based on information detected by the detection element and the set threshold value;

determining, based on the inspection result obtained by inspecting the discharge status of the selected nozzle by the inspection unit, a threshold value to be used by the inspection unit for inspecting the discharge status of the selected nozzle in a subsequent inspection; and storing the determined threshold value in a memory, wherein the discharge status is inspected in the inspecting plural times by setting a plurality of different threshold values for the selected nozzle, and the threshold value to be used for inspecting the discharge status of the selected nozzle in the subsequent inspection is determined in the determining based on a plurality of inspection results that have been obtained from inspecting the discharge status in the inspecting plural times by setting the plurality of different threshold values and that have been obtained by the inspection unit.

18. The method according to claim 17, wherein the inspecting includes:

generating a selection signal for selecting, among the plurality of nozzles, a nozzle as a target of inspection of the discharge status and an inspection threshold signal indicating the threshold value, and outputting the selection signal and the inspection threshold signal to the printhead; and issuing an instruction to change the nozzle indicated by the selection signal and the threshold value indicated by the inspection threshold signal.

19. The method according to claim 18, wherein in the determining, the threshold value indicated by the inspection threshold signal used when a change in an inspection result signal indicating the inspection result is obtained for the nozzle selected by the selection signal is determined as the threshold value for inspecting the discharge status of the nozzle selected by the selection signal.

20. The method according to claim 19, wherein the change in the inspection result signal indicates one of a change of the inspection result from normal discharge to discharge failure and a change of the inspection result from discharge failure to normal discharge.

21. The method according to claim 18, wherein in the issuing, nozzles as inspection targets are instructed one by one.

22. The method according to claim 21, wherein in the issuing, the threshold value is changed by a predetermined value from a possible maximum value of the threshold value, each time a change is to be made.

23. The method according to claim 21, wherein in the issuing, the threshold value is changed by a predetermined value from a threshold value obtained in a last inspection and stored in the memory, each time a change is to be made.

24. The method according to claim 17, wherein each of the energy generating elements comprises a heater for heating the liquid and configured to generate thermal energy, and wherein each of the detection elements detects temperature information used for inspection.

* * * * *